US011400466B2

(12) United States Patent
Arichi et al.

(10) Patent No.: US 11,400,466 B2
(45) Date of Patent: Aug. 2, 2022

(54) COATING APPARATUS AND COATING METHOD

(71) Applicant: Ransburg Industrial Finishing K.K., Yokohama (JP)

(72) Inventors: Akihiko Arichi, Kariya (JP); Tatsuya Tanikawa, Kariya (JP); Masato Miura, Kariya (JP); Osamu Yoshida, Yokohama (JP); Yoshiji Yokomizo, Yokohama (JP); Naohiro Masuda, Yokohama (JP)

(73) Assignee: Ransburg Industrial Finishing K.K., Yokohama (JP)

( * ) Notice: Subject to any disclaimer, the term of this patent is extended or adjusted under 35 U.S.C. 154(b) by 1301 days.

(21) Appl. No.: 15/130,824

(22) Filed: Apr. 15, 2016

(65) Prior Publication Data

US 2016/0303588 A1 Oct. 20, 2016

(30) Foreign Application Priority Data

Apr. 17, 2015 (JP) ..... JP2015-084877

(51) Int. Cl.
*B05B 5/04* (2006.01)
*B05D 1/04* (2006.01)
(Continued)

(52) U.S. Cl.
CPC ..... *B05B 5/0426* (2013.01); *B05B 5/0403* (2013.01); *B05B 5/053* (2013.01);
(Continued)

(58) Field of Classification Search
CPC ..... B05B 5/04; B05B 5/0426; B05B 5/0403
See application file for complete search history.

(56) References Cited

U.S. PATENT DOCUMENTS 2,996,042 A 8/1961 Juvinall
6,708,908 B2 * 3/2004 Heldt ..... B05B 5/04 239/690
(Continued)

FOREIGN PATENT DOCUMENTS

CN 100553790 C 10/2009
CN 102341182 A 2/2012
(Continued)

OTHER PUBLICATIONS

Extended European Search Report for EP Application No. 16165619.4 dated Aug. 17, 2016, 9 pgs.
(Continued)

*Primary Examiner* — Alexander M Weddle
(74) *Attorney, Agent, or Firm* — Fletcher Yoder, P.C.

(57) ABSTRACT

To improve actual coating efficiency, the present invention has a coating robot provided with a coating unit configured by a plurality of rotary atomizing type electrostatic coating machines horizontally arranged, and a coating control apparatus that controls the coating unit and the coating robot. A diameter of each of bells is 50 mm or less. The coating material discharge amount of each rotary atomizing type electrostatic coating machine is 400 cc/min or less. A coating distance between each bell and a surface to be coated of a workpiece is controlled between 50 mm to 150 mm. The coating material discharge amounts of the plurality of electrostatic coating machines are controlled for the respective coating machines. The control of the coating material discharge amounts includes a pause of coating material discharge.

16 Claims, 5 Drawing Sheets

(51) Int. Cl.

| | |
|---|---|
| ***B05B 12/12*** | (2006.01) |
| ***B05B 12/04*** | (2006.01) |
| ***B05B 12/08*** | (2006.01) |
| ***B05B 5/053*** | (2006.01) |

(52) U.S. Cl.
CPC ..... *B05B 12/04* (2013.01); *B05B 12/08* (2013.01); *B05B 12/084* (2013.01); *B05B 12/124* (2013.01); *B05D 1/04* (2013.01)

(56) References Cited

U.S. PATENT DOCUMENTS

| | | | | |
|---|---|---|---|---|
| 7,143,963 | B2 * | 12/2006 | Tani | B05B 1/1681 239/456 |
| 2005/0136190 | A1 | 6/2005 | Tani et al. | |
| 2007/0042123 | A1 | 2/2007 | Endregaard et al. | |
| 2007/0262170 | A1 * | 11/2007 | Nolte | B05B 5/001 239/291 |
| 2007/0289358 | A1 * | 12/2007 | Eickmeyer | B05B 12/00 73/1.36 |
| 2011/0000974 | A1 * | 1/2011 | Nolte | B05B 5/0407 239/3 |
| 2012/0006916 | A1 | 1/2012 | Nolte et al. | |
| 2015/0129690 | A1 * | 5/2015 | Rodgers | B05B 5/0407 239/695 |

FOREIGN PATENT DOCUMENTS

| | | | |
|---|---|---|---|
| CN | 104349843 | A | 2/2015 |
| DE | 102009013979 | A1 | 9/2010 |
| EP | 1733799 | A1 | 12/2006 |
| JP | 2004305874 | A | 11/2004 |
| JP | 2010051891 | A | 3/2010 |
| JP | 2012520753 | A5 | 5/2013 |

OTHER PUBLICATIONS

Rotary Bell Atomizers Metallic paints | Water-Based paints, Mar. 31, 2012, France, http://www.kremlinrexson-sames.com/fichiers/Literature/English/Sames_literature/2012_Rotary_Bell_Atomizers.pdf, 6 pgs.

Chinese Office Action for CN Application No. 2016102357347 dated Mar. 15, 2019, 10 pgs.

EP Examination Report for EP Application No. 16165619.4 dated May 23, 2019, 6 pgs.

Japanese Office Action for JP Application No. 2016-043936 dated Oct. 8, 2019, 3 pgs.

* cited by examiner

COATING APPARATUS AND COATING METHOD

CROSS REFERENCE TO RELATED APPLICATION

This application claims priority from and the benefit of Japanese Patent Application No. 2015-084877, entitled "COATING APPARATUS AND COATING METHOD," filed Apr. 17, 2015, which is hereby incorporated by reference in its entirety.

BACKGROUND

The present invention generally relates to a coating apparatus and a coating method. More specifically, the coating apparatus includes a coating unit provided with a plurality of small rotary atomizing type electrostatic coating machines.

Japanese Patent Laid-Open No. 2004-305874 discloses a rotary atomizing type electrostatic coating machine that can variably control a spray pattern. Herein, the "spray pattern" means a contour shape of a coating material adhered to a surface to be coated when the coating material is sprayed in a state where the coating machine stops, as specified in Japanese Patent Laid-Open No. 2004-305874.

Generally, in order to secure uniformity of coating quality, passing of spray patterns is performed at any portions of a surface to be coated a plurality of times. That is, recoating is sequentially performed several times, so that the uniformity of the coating quality is secured. Overspray is performed such that a difference in coating quality between a central part and an edge part of the surface to be coated is not caused. The "overspray" means a state where a coating material is sprayed in a state where the spray pattern protrudes from an edge of a surface to be coated.

As described in Japanese Patent Laid-Open No. 2004-305874, when the overspray is performed, the following problems occur. (1) Among a coating material sprayed by the electrostatic coating machine, a coating material that is not involved in coating of the surface to be coated is generated. That is, a waste coating material is generated. (2) Lines of electric force of an electrostatic field are concentrated at an edge part of a surface to be coated. The coating material is intensively adhered to an edge part of a surface to be coated by the overspray. (3) A coating material that scatters to the periphery of the surface to be coated increases, and contaminates the surroundings of the surface to be coated.

In order to solve such problems, Japanese Patent Laid-Open No. 2004-305874 proposes that the above spray pattern is variably controlled. When description is made taking an example of a vehicle body, for example, coating to a large surface to be coated such as a hood and a roof is performed by a large spray pattern. Coating to a narrow surface to be coated such as a front pillar (A-pillar), a center pillar (B-pillar), and a rear pillar (C-pillar) is performed by a small spray pattern.

SUMMARY

In the rotary atomizing type electrostatic coating machine, coating particles that scatter from a rotating atomizing head or bell are directed to a surface to be coated (e.g., a workpiece) by shaping air, and charged coating particles are electrostatically adhered to the surface to be coated. There is an advantage that the rotary atomizing type electrostatic coating machine has higher coating efficiency compared to a spray gun. However, utilizing rotary atomizing type electrostatic coating machines may result in a part of coating particles flying from the coating machine toward a workpiece scatters around the surroundings by shaping air flow and an accompanying air flow by the bell rotating at a high speed. Consequently, it is recognized that an upper limit of the actual coating efficiency of the rotary atomizing type electrostatic coating machine that is applied to the vehicle body is about 70%.

As used herein, the actual coating efficiency is different from a coating efficiency mentioned by a coating machine manufacturer. The coating efficiency mentioned by the coating machine manufacturer means an index of performance of a coating machine. The coating machine manufacturer uses the words coating efficiency in order to inform a user about a ratio of a coating material adhered to a workpiece among a coating material sprayed to a prescribed vertical flat surface (e.g., the workpiece).

When reference is made to an example of a vehicle body, (e.g., in a case where a narrow portion such as a pillar is coated), a ratio of a coating material adhered to the pillar among a sprayed coating material is reduced by an influence of the overspray. On the other hand, in a case where a wide surface such as a hood of a vehicle body is coated, coating efficiency is better compared to the pillar. In order to distinguish the coating efficiency mentioned by the user from the coating efficiency mentioned by the coating machine manufacturer, the coating efficiency mentioned by the user is referred to as "actual coating efficiency." The actual coating efficiency of the vehicle body is 60% to 70%.

An object of the present invention is to provide a coating apparatus and a coating method capable of implementing actual coating efficiency higher than actual coating efficiency of about 70% that is conventionally considered as an upper limit.

Another object of the present invention is to provide a coating apparatus and a coating method capable of improving yield of a coating material.

Yet another object of the present invention is to provide a coating apparatus and a coating method capable of reducing an amount of a coating material scattering to a periphery, and reducing contamination of surroundings of a surface to be coated by the coating material.

According to one aspect of the present invention, the above technical problems are solved by providing a coating apparatus comprising: a coating unit configured by a plurality of rotary atomizing type electrostatic coating machines disposed adjacent to each other; a coating manipulator on which the coating unit is mounted; and a coating control apparatus that controls the coating unit and the coating manipulator, wherein a diameter of an atomizing head of each of the rotary atomizing type electrostatic coating machines is 50 mm or less, wherein a coating material discharge amount of each of the rotary atomizing type electrostatic coating machines is 400 cc/min or less, wherein the coating control apparatus controls the coating unit to keep the atomizing head within a coating distance between 50 mm to 150 mm from a surface to be coated of a workpiece, wherein the coating control apparatus controls the coating material discharge amounts of the plurality of rotary atomizing type electrostatic coating machines independently from one another thereof, and wherein the control of the coating material discharge amounts of the respective rotary atomizing type electrostatic coating machines includes a pause of coating material discharge from the rotary atomizing type electrostatic coating machines.

According to another aspect of the present invention, the above technical problems are solved by providing a coating method using a coating apparatus having: a coating unit configured by a plurality of rotary atomizing type electrostatic coating machines disposed adjacent to each other; a coating manipulator on which the coating unit is mounted; and a coating control apparatus that controls the coating unit and the coating manipulator, wherein a diameter of an atomizing head of each of the rotary atomizing type electrostatic coating machines is 50 mm or less, wherein a coating material discharge amount of each of the rotary atomizing type electrostatic coating machines is 400 cc/min or less, wherein the coating control apparatus controls the coating unit to keep the atomizing head within a coating distance between 50 mm to 150 mm from a surface to be coated of a workpiece, wherein the coating control apparatus controls the coating material discharge amounts of the plurality of rotary atomizing type electrostatic coating machines independently from one another thereof, and wherein the control of the coating material discharge amounts of the respective rotary atomizing type electrostatic coating machines includes a pause of coating material discharge from the rotary atomizing type electrostatic coating machines, the coating method comprising: discharging a coating material from all of the plurality of rotary atomizing type electrostatic coating machines in coating in a relative wide surface to be coated; and stopping discharging of a coating material of a rotary atomizing type electrostatic coating machine that performs overspray, among the plurality of rotary atomizing type electrostatic coating machines, in coating in a relative small surface to be coated, or in coating becoming overspray.

According to the present invention, the plurality of small rotary atomizing type electrostatic coating machines are provided as a single unit, the coating distance is reduced, and the coating discharge amount of each electrostatic coating machine can be limited to 400 cc/min or less, preferably limited to 50 cc/min to 350 cc/min, and more preferably limited to 50 cc/min to 300 cc/min, so that it is possible to implement high actual coating efficiency. Additionally, it is possible to reduce the amount of a coating material scattering to the surroundings of the electrostatic coating machines.

In coating in the small surface to be coated or a narrow surface to be coated, or in coating becoming overspray such as coating in an edge(s), a corner part(s) or the like of a wide surface to be coated, the discharge of the coating material of the rotary atomizing type electrostatic coating machine that might perform overspray is paused, so that it is possible to eliminate waste of the coating material by the overspray. Consequently, it is possible to improve yield of the coating material.

DETAILED DESCRIPTION

Hereinafter, preferred embodiments of the present invention will be described with reference to the attached drawings. The following embodiments are examples in which the present invention is applied to an articulated coating robot, as a representative example. The present invention is not limited to a coating robot, and can be applied to a coating manipulator including a reciprocator.

Figure 1:
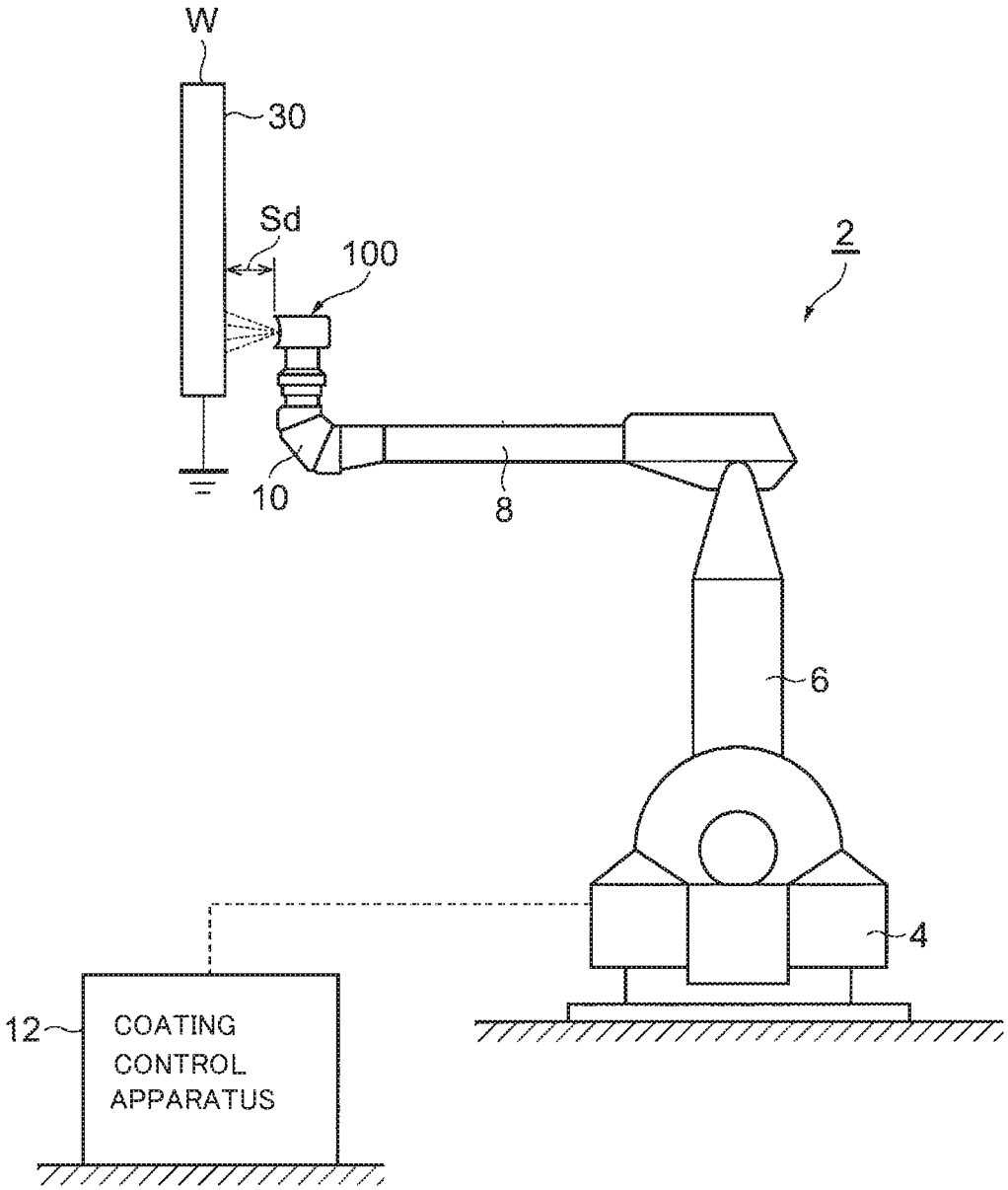
FIG. 1 is a diagram for schematically explaining a whole of a coating system including a coating robot for a vehicle body assembled with a coating unit of an embodiment at wrist part of the coating robot.

FIG. 1 shows a coating robot 2 installed in a coating line of a vehicle body. The coating robot 2 includes base 4, and a vertical arm 6 disposed on the base 4. The vertical arm 6 is rotatable and swingable with respect to the base 4.

The coating robot 2 further includes a horizontal arm 8 disposed at a free end, namely, an upper end of the vertical arm 6. The horizontal arm 8 is swingable with respect to the vertical arm 6. A coating unit 100 is mounted on an articulated wrist part 10 located at a distal end of the horizontal arm 8. The coating robot 2 and the coating unit 100 are controlled by a coating control apparatus 12.

Figure 2:
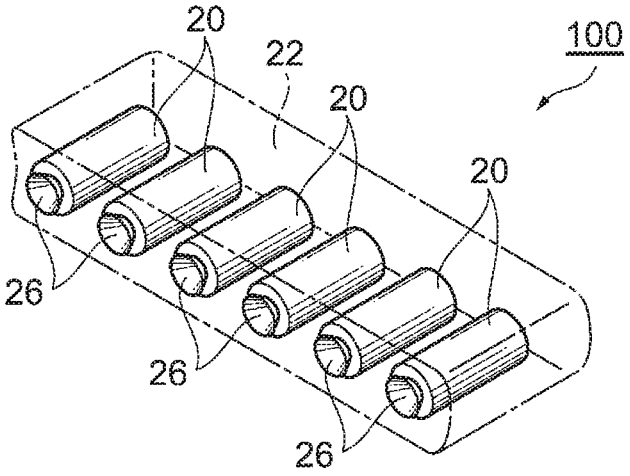
FIG. 2 is a perspective view of a coating unit included in a first embodiment.
Figure 3:
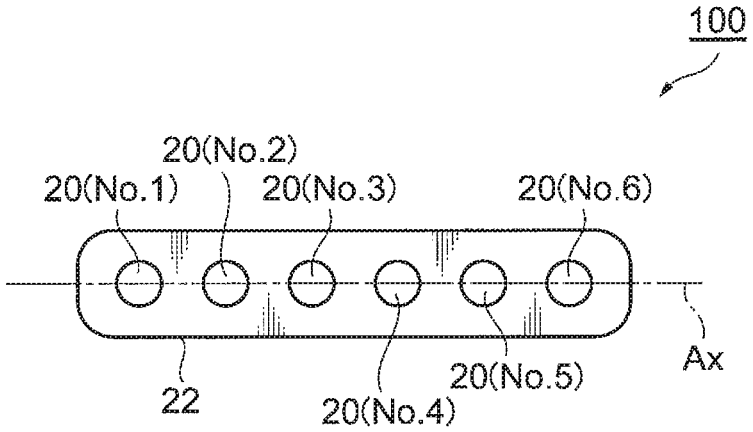
FIG. 3 is a front view of the coating unit included in the first embodiment.

FIG. 2 is a schematic diagram of the coating unit 100, and FIG. 3 is a front view of the coating unit 100. The coating unit 100 includes a plurality of rotary atomizing type electrostatic coating machines 20 having the same structure and the same size, and a box 22 supporting the rotary atomizing type electrostatic coating machines 20. That is, the coating unit 100 has a configuration in which the one box 22 supports the plurality of rotary atomizing type electrostatic coating machines 20. The coating unit 100 included in this first embodiment is configured by the six rotary atomizing type electrostatic coating machines 20 arranged in a single line at equal intervals on a longitudinal axis Ax (FIG. 3) of the box 22. However, the number of the rotary atomizing type electrostatic coating machines 20 is two or more, preferably three or more, more preferably four or more. The number of the rotary atomizing type electrostatic coating machines 20 is arbitrary.

Figure 4:
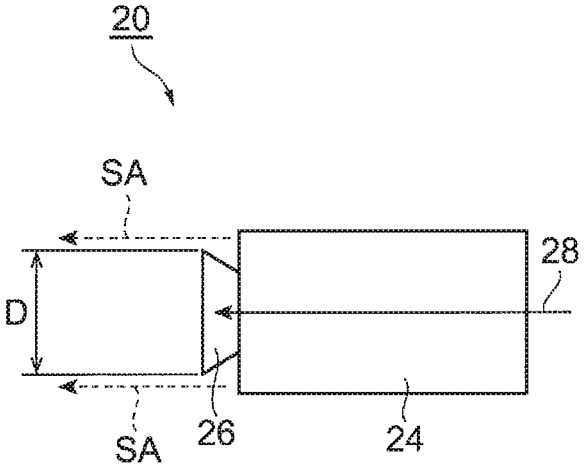
FIG. 4 is an explanatory diagram as a rotary atomizing type electrostatic coating machine configuring the coating unit is viewed from a side surface.

FIG. 4 is a diagram for schematically explaining the rotary atomizing type electrostatic coating machines 20. Each of the electrostatic coating machines 20 has the same mechanism as conventionally known rotary atomizing type electrostatic coating machines. That is, the electrostatic coating machine 20 has a main body 24 and a rotary atomizing head (e.g., a bell) 26, similarly to the conventional electrostatic coating machine. The electrostatic coating machine 20 of the embodiment is smaller than the conventional electrostatic coating machine. The diameter D of the bell 26 is, for example, 30 mm (2.28 inches (in.)), but is preferably 50 mm (1.97 in.) or less, and is more preferably 20 mm to 40 mm (0.79 to 1.57 in.).

The main body 24 includes a high voltage generator that supplies a high voltage to the bell 26, and an air motor (not shown) that rotates bell 26. A coating material is supplied to a central part of the bell 26. A center field tube that supplies the coating material to the bell 26 is denoted by reference numeral 28. For example, in a case where the diameter of the bell 26 is 50 mm (1.97 in.), the coating material amount, namely, the coating material discharge amount of the electrostatic coating machine 20 may be 400 cc/min or less, or may be several cc/min to several tens of cc/min, which is a slight amount. The coating material discharge amount is 50 cc/min to 400 cc/min, preferably 50 cc/min to 350 cc/min, and most preferably 50 cc/min to 300 cc/min.

Shaping air SA is discharged from air holes (not shown) disposed on a front end surface of the main body 24. A spray pattern is defined by the shaping air SA. The discharge amount of the shaping air SA of each electrostatic coating machine 20 is 0 (zero) NL/min to 200 NL/min, and preferably 50 NL/min to 150 NL/min. When the bell 26 having a diameter of 30 mm (1.18 in.) is employed, the coating material discharge amount is preferably 300 cc/min or less, and the discharge amount of the shaping air SA is preferably about 150 NL/min.

Referring to FIG. 1 again, a longitudinal piece is illustrated as a workpiece W in FIG. 1 in place of a vehicle body. This is to facilitate understanding of explanation of a coating distance Sd between the bell 26 of each rotary atomizing type electrostatic coating machine 20 of the coating unit 100 and a surface 30 to be coated of the workpiece W. When coating is performed by using the coating unit 100 included in the embodiment, the coating distance Sd between the bell 26 (which does not appear in FIG. 1) and the surface 30 to be coated is 50 mm to 150 mm (1.97 to 5.91 in.). A person skilled in the art may appreciate that the numerical value of this coating distance Sd is an extremely small value compared to a conventional numerical value. Incidentally, in coating of a vehicle body, a conventionally general coating distance Sd is 200 mm to 300 mm (7.87 to 11.81 in.).

As can be seen from the above description, the rotary atomizing type electrostatic coating machines 20 of the coating unit 100 included in the first embodiment are smaller than the conventional rotary atomizing type electrostatic coating machines. That is, the diameters of the bells 26 are smaller than the diameters of the conventional bells. Additionally, the coating material discharge amount of each rotary atomizing type electrostatic coating machine 20 is smaller than the coating material discharge amount of the conventional rotary atomizing type electrostatic coating machine. And also, the discharge amount of the shaping air SA is smaller than the discharge amount of conventional shaping air. The coating distance Sd of each rotary atomizing type electrostatic coating machine 20 is also smaller than the coating distance of the conventional rotary atomizing type electrostatic coating machine.

That is, when coating is performed, the coating unit 100 included in the first embodiment is positioned at a position extremely close to the surface 30 to be coated of the workpiece W. The discharge amount of the shaping air SA is also smaller than the discharge amount of the conventional shaping air. Then, the coating material discharged by the one ultra-small electrostatic coating machine 20 is smaller than the coating material of the conventional electrostatic coating machine, but the whole of the coating unit 100 can discharge the coating material whose amount is equal to or more than the amount of a conventional coating machine.

Figure 5:
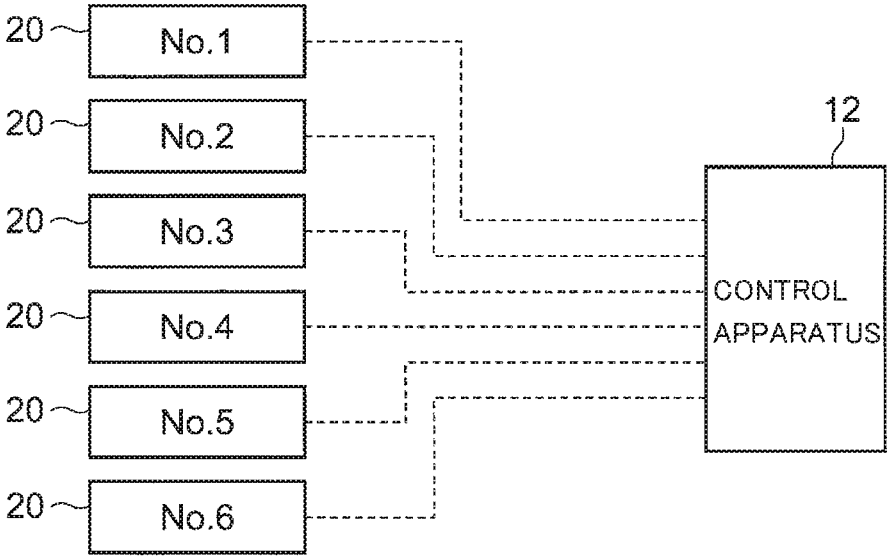
FIG. 5 is a control system diagram of six small electrostatic coating machines included in the coating unit.

FIG. 5 is a diagram for explaining that the plurality of rotary atomizing type electrostatic coating machines 20 configuring the single coating unit 100 can be individually and independently controlled by the coating control apparatus 12. With reference to FIG. 3 and FIG. 5, at least discharge of the coating material of, for example, the six electrostatic coating machines 20 included in the coating unit 100, namely, the electrostatic coating machines 20 of No. 1 to No. 6 is individually and independently controlled by the coating control apparatus 12. Of course, application of a high voltage, and discharge of the shaping air SA may be also independently controlled for each electrostatic coating machine 20.

Figure 6:
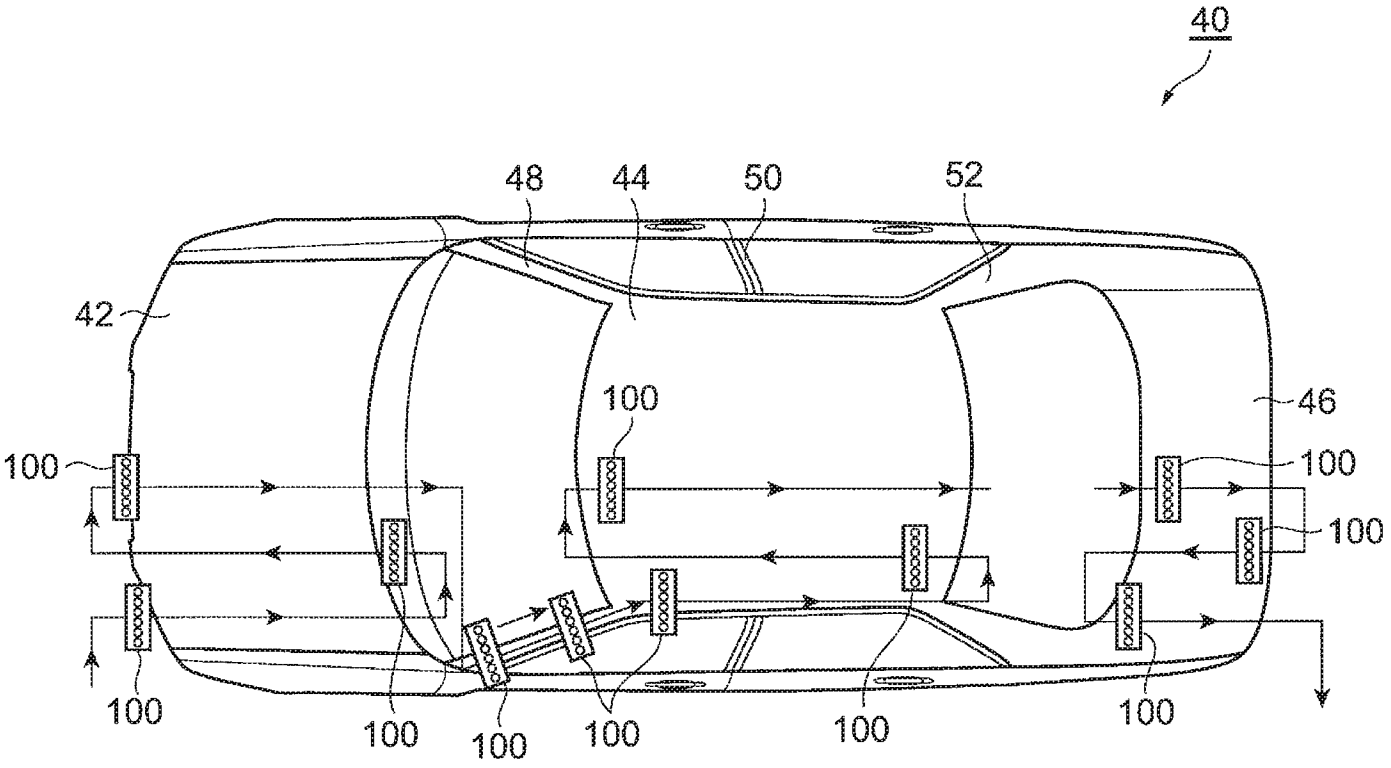
FIG. 6 is a diagram for explaining a coating method in a relative wide surface to be coated (for example, a roof) and a relative narrow surface to be coated (pillar), taking an example of a vehicle body.

FIG. 6 is a diagram as a vehicle body 40 which is an object W to be coated (e.g., the workpiece) is viewed from the above. In FIG. 6, reference numeral 42 denotes a hood. Reference numeral 44 denotes a roof. Reference numeral 46 denotes a trunk lid. The hood 42 and the roof 44 have relative wide surfaces to be coated. Reference numeral 48 denotes an A-pillar, reference numeral 50 denotes a B-pillar, and reference numeral 52 denotes a C-pillar. These pillars have relative narrow surfaces to be coated.

With reference to FIG. 6, a coating method of the vehicle body 40 will be described. In the wide surface to be coated such as the hood 42, the longitudinal axis Ax (FIG. 3) of the coating unit 100 is positioned in a state orthogonal to an advancing direction of the coating unit 100. That is, a plurality of the electrostatic coating machines 20 are positioned above the hood 42 or the like in a state of being laterally aligned in a line, and then advance. A movement locus of the coating unit 100 is illustrated by solid lines. The coating material is discharged from all of the electrostatic coating machines 20 included in the coating unit 100.

At an edge(s) or a corner part(s) of the hood 42, in coating which might become overspray, some electrostatic coating machines 20 located outside the edge of the hood 42 are brought into a pause state, and the coating material is discharged from a single or a plurality of the electrostatic coating machines 20 located inside of the edge.

In the narrow surface to be coated such as the A-pillar 48, for example, the longitudinal axis Ax (FIG. 3) of the coating unit 100 is positioned in a state orthogonal to or oblique to an advancing direction of the coating unit 100. Then, for example, the coating material is discharged from the one or two electrostatic coating machines 20 corresponding to the narrow surface to be coated (A-pillar 48), and other electrostatic coating machines 20 that might perform overspray are brought into the pause state.

As can be seen from the above description, in the wide surface to be coated, the coating material is discharged from all of the electrostatic coating machines 20. At the edge(s) or the corner part(s) of the wide surface to be coated, the single or the plurality of electrostatic coating machines 20 located at the region becoming overspray are brought into the pause state. In the narrow or small surface to be coated, the coating material is discharged from the single or the plurality of electrostatic coating machines 20 that are sufficient to coat this narrow or small surface to be coated, and the single or the plurality of electrostatic coating machines 20 located at the region becoming overspray are brought into the pause state.

It is difficult to make the coating quality of metallic coating uniform. When the shaping air SA is changed, this change causes difference in the quality of the metallic coating. In the coating using the coating unit 100 of the embodiment, it is preferable to control discharge or non-discharge of the coating material of each electrostatic coating machine 20 while the shaping air SA is discharged from all of the electrostatic coating machines 20. Consequently, it is possible to suppress nonuniformity of the quality of the metallic coating.

As can be seen from the above description, each of the small electrostatic coating machines 20 is located at a position extremely close to the surface 30 to be coated compared to the conventional electrostatic coating machine, and the discharge amount of the shaping air SA is smaller than the discharge amount of the conventional shaping air, and therefore the amount of the coating material scattering to the surroundings of the electrostatic coating machines 20 can be sharply reduced. In other words, it is possible to significantly improve actual coating efficiency compared to the conventional electrostatic coating machine.

Additionally, discharge/non-discharge of the coating material from the plurality of electrostatic coating machines 20 of the unit is controlled, so that the size of the spray pattern can be substantially variably controlled. Consequently, it is possible to significantly reduce the amount of the coating material that is wasted by the overspray. Therefore, it is possible to improve the yield of the coating material.

Figure 7:
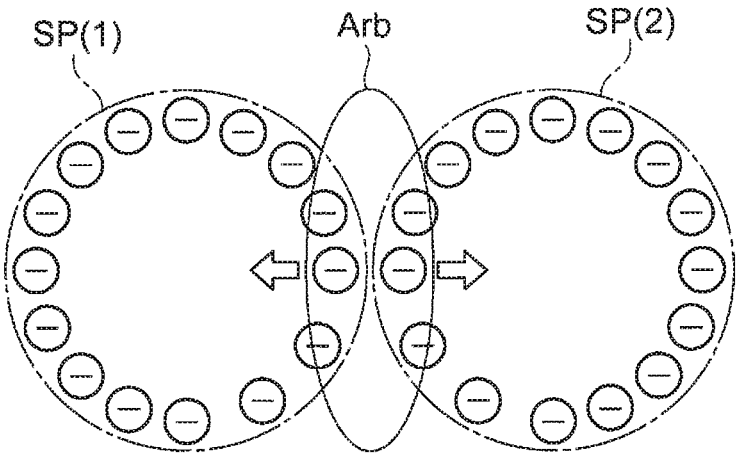
FIG. 7 is a diagram for explaining a problem that occurs between two spray patterns produced by two adjacent electrostatic coating machines.

FIG. 7 shows spray patterns SP formed by the adjacent two electrostatic coating machines 20. In a boundary region Arb between the adjacent first spray pattern SP(1) and second spray pattern SP(2), coating material particles, which are charged to the same polarity, repel each other. As a result, there is a possibility that the boundary region Arb between the first and second spray patterns SP(1) and SP(2) becomes a relatively thin coating film.

Figure 8:
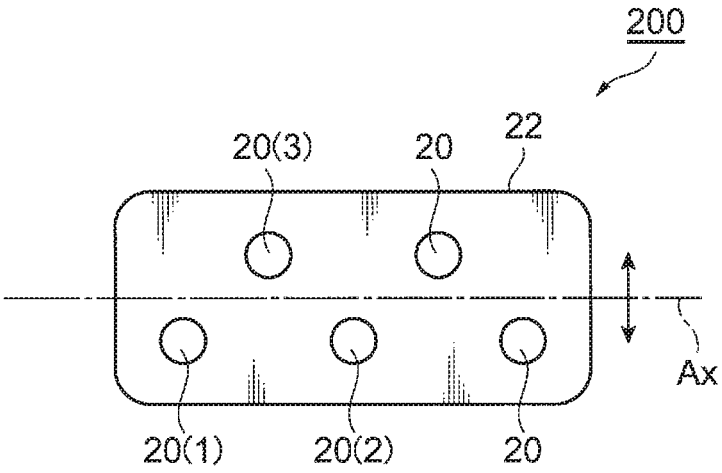
FIG. 8 is a front view of a coating unit included in a second embodiment, which is a diagram corresponding to FIG. 3.

FIG. 8 shows a coating unit 200 of a second embodiment. FIG. 8 is a diagram corresponding to the aforementioned FIG. 3 (coating unit 100 of the first embodiment). The second embodiment is different from the first embodiment in placement or arrangement of a plurality of rotary atomizing type electrostatic coating machines 20. With reference to FIG. 8, in a coating unit 200 of the second embodiment, a plurality of the electrostatic coating machines 20 are arranged in a zigzag manner. The coating unit 200 of the second embodiment includes at least three electrostatic coating machines 20.

According to the coating unit 200 of the second embodiment, for example, in a case where coating is performed while the coating unit 200 advances in a direction orthogonal to a longitudinal axis Ax, a third electrostatic coating machine 20(3) is located between horizontally adjacent two first and second electrostatic coating machines 20(1) and 20(2). Consequently, a region between two spray patterns produced by the first and second electrostatic coating machines 20(1) and 20(2) can be buried by a spray pattern produced by the third electrostatic coating machine 20(3). That is, the thin film thickness of the boundary region Arb described with reference to FIG. 7 can be corrected by the spray pattern of the third electrostatic coating machine 20(3). Consequently, it is possible to enhance uniformity of the thickness of a coating film produced by the coating unit 200.

2 articulated coating robot (coating manipulator)
10 wrist part of coating robot
12 coating control apparatus
100 coating unit
20 rotary atomizing type electrostatic coating machine
26 rotary atomizing head (bell)
SA shaping air
W workpiece (object to be coated)
30 surface to be coated
Sd coating distance

What is claimed is:

1. A coating apparatus, comprising:

a coating unit comprising a plurality of rotary atomizing type electrostatic coating machines disposed adjacent to each other;

a coating manipulator on which the coating unit is mounted; and a coating control apparatus configured to control the coating unit and the coating manipulator, wherein a diameter of an atomizing head of each of the rotary atomizing type electrostatic coating machines is 50 mm or less, wherein the coating control apparatus is configured to independently control a voltage applied to the atomizing head of each of the rotary atomizing type electrostatic coating machines, wherein the coating control apparatus is configured to control each of the rotary atomizing type electrostatic coating machines to discharge coating material at a rate of 400 cc/min or less, wherein the coating control apparatus is configured to control the coating unit to keep the atomizing head within a coating distance between 50 mm to 150 mm from a surface of a workpiece to be coated, wherein the coating control apparatus is configured to control coating material discharge amounts of each of the rotary atomizing type electrostatic coating machines independently from one another thereof, and wherein the coating control apparatus is configured to control each of the rotary atomizing type electrostatic coating machines to include a pause of coating material discharge from the rotary atomizing type electrostatic coating machines.

2. The coating apparatus of claim 1, wherein the plurality of rotary atomizing type electrostatic coating machines included in the coating unit are arranged in a line.

3. The coating apparatus of claim 2, wherein the diameter of the atomizing head of each of the rotary atomizing type electrostatic coating machines is 20 mm to 40 mm.

4. The coating apparatus of claim 2, wherein the coating control apparatus is configured to control each of the rotary atomizing type electrostatic coating machines to discharge the coating material at the rate of 50 cc/min to 350 cc/min.

5. The coating apparatus of claim 2, wherein the coating control apparatus is configured to control each of the rotary atomizing type electrostatic coating machines to discharge the coating material at the rate of 50 cc/min to 300 cc/min.

6. The coating apparatus of claim 2, wherein each of the rotary atomizing type electrostatic coating machines has air holes configured to discharge shaping air.

7. The coating apparatus of claim 2, wherein the coating control apparatus is configured to control each of the rotary atomizing type electrostatic coating machines to discharge shaping air at a rate of 50 NL/min to 150 NL/min.

8. The coating apparatus of claim 1, wherein the plurality of rotary atomizing type electrostatic coating machines included in the coating unit are arranged in a zigzag manner.

9. The coating apparatus of claim 8, wherein the diameter of the atomizing head of each of the rotary atomizing type electrostatic coating machines is 20 mm to 40 mm.

10. The coating apparatus of claim 8, wherein the coating control apparatus is configured to control each of the rotary atomizing type electrostatic coating machines to discharge the coating material at the rate of 50 cc/min to 350 cc/min.

11. The coating apparatus of claim 8, wherein the coating control apparatus is configured to control each of the rotary atomizing type electrostatic coating machines to discharge the coating material at the rate of 50 cc/min to 300 cc/min.

12. The coating apparatus of claim 8, wherein each of the rotary atomizing type electrostatic coating machines has air holes configured to discharge shaping air.

13. The coating apparatus of claim 8, wherein the coating control apparatus is configured to control each of the rotary atomizing type electrostatic coating machines to discharge shaping air at a rate of 50 NL/min to 150 NL/min.

14. The coating apparatus of claim 1, wherein the coating control apparatus is configured to control each of the rotary atomizing type electrostatic coating machines to discharge shaping air at a rate of 50 NL/min to 150 NL/min.

15. The coating apparatus of claim 1, wherein each of the rotary atomizing type electrostatic coating machines is configured to discharge shaping air via corresponding air holes of the rotary atomizing type electrostatic coating machines, wherein the coating control apparatus is configured to independently control the discharge of the shaping air from each of the rotary atomizing type electrostatic coating machines.

16. A coating method using a coating apparatus having:

a coating unit comprising a plurality of rotary atomizing type electrostatic coating machines disposed adjacent to each other;

a coating manipulator on which the coating unit is mounted; and a coating control apparatus configured to control the coating unit and the coating manipulator, wherein a diameter of an atomizing head of each of the rotary atomizing type electrostatic coating machines is 50 mm or less, wherein the coating control apparatus is configured to independently control a voltage applied to the atomizing head of each of the rotary atomizing type electrostatic coating machines, wherein the coating control apparatus is configured to control each of the rotary atomizing type electrostatic coating machines to discharge coating material at a rate of 400 cc/min or less, wherein the coating control apparatus is configured to control the coating unit to keep the atomizing head within a coating distance between 50 mm to 150 mm from a surface of a workpiece to be coated, wherein the coating control apparatus is configured to control coating material discharge amounts of each of the rotary atomizing type electrostatic coating machines independently from one another, and wherein the coating control apparatus is configured to control each of the rotary atomizing type electrostatic coating machines to include a pause of coating material discharge from the rotary atomizing type electrostatic coating machines by:

discharging the coating material from each of the plurality of rotary atomizing type electrostatic coating machines while coating a relatively wide surface to be coated; and stopping discharge of coating material from a first rotary atomizing type electrostatic coating machine of the plurality of rotary atomizing type electrostatic coating machines that performs overspray while coating a relatively small surface to be coated, or when the coating material becomes overspray.

* * * * *